United States Patent [19]

Howard

[11] Patent Number: 5,062,185

[45] Date of Patent: Nov. 5, 1991

[54] CONCEALED TIE CLASP

[76] Inventor: Roy T. Howard, 973 Acacia Ave., Sacramento, Calif. 95815

[21] Appl. No.: 619,598

[22] Filed: Nov. 29, 1990

[51] Int. Cl.[5] ..... A41D 25/04

[52] U.S. Cl. ..... 24/49 CC; 24/49 CF; 24/49 TS

[58] Field of Search ..... 24/49 R, 49 CF, 49 K, 24/49 M, 49 CC, 49 P, 49 TS, 49 C, 49 L

[56] References Cited

U.S. PATENT DOCUMENTS

| | | | |
|---|---|---|---|
| 876,172 | 1/1908 | Grossgebauer | 24/49 TS |
| 1,726,185 | 8/1929 | Kremski et al. | 24/49 TS X |
| 2,037,864 | 4/1936 | Mix | 24/49 CF |
| 3,968,544 | 7/1976 | Sinclair | 24/49 CF |
| 4,955,112 | 9/1990 | Porter | 24/49 CF X |

FOREIGN PATENT DOCUMENTS

| | | | |
|---|---|---|---|
| 3493 | of 1906 | United Kingdom | 24/49 CF |

*Primary Examiner*—Laurie K. Cranmer
*Attorney, Agent, or Firm*—Norman B. Rainer

[57] ABSTRACT

A concealable tie clasp is constructed in a manner such that it attaches to the button hole edge of a shirt and slidably engages the designer label which is generally sewn onto the rear surface of the front panel of a four-in-hand necktie. The tie clasp engages the shirt by means of a spring-loaded type of alligator clip. A vertically elongated holding loop is disposed on the forward surface of the alligator clip for engaging the designer label. Once the tie is engaged by the holding loop the tie remains generally centered above the vertical row of buttons on the shirt, yet is permitted limited vertical and horizontal movement.

4 Claims, 2 Drawing Sheets

CONCEALED TIE CLASP

BACKGROUND OF THE INVENTION

This invention relates to a holding device for releasibly securing a four-in-hand necktie to a shirt which does not adversely affect the tie and is hidden from view behind the tie.

A four-in-hand necktie is an elongated fabric item symmetrically configured about its center axis of elongation, and having a perimeter edge which generally defines a narrow extremity and opposed wider extremity. The necktie is usually constructed of a double layer of fabric comprising an unbroken front surface, and a rear surface wherein the fabric has been folded about said perimeter edge and is joined by a seam along said axis. A designer label is generally sewn onto said rear surface as an elongated loop perpendicularly bisected by said axis.

In use, the center portion of the necktie is placed under the collar of a shirt and a knot is fashioned in the necktie in front of the collar and in a manner to dispose the necktie as front and rear panels pendant from the knot. The wider extremity is generally the front panel, and is usually caused to be slightly larger than the rear panel comprised of a narrow extremity. Said rear panel is further caused to pass through the designer loop sewn to the rear surface of the front panel.

Many devices have been earlier disclosed for securing the pendant panels of the four-in-hand type necktie whereby the panels stay together in substantially vertically centered relationship above the line of buttons in front of the wearer's shirt. The more well-known devices include conventional tie clasps and tie tacks. However, these devices are visible when worn, and tie tacks inherently pierce the front panel, causing damage to this visible portion after repeated use. Clasps that comprise a horizontally elongated member adapted to be positioned upon the front panel must often be matched to the width of the panel, which changes with periodic style preferences.

Moreover, many people desire the near appearance of a secured necktie, but prefer a device which is not visible when worn. Such devices have been disclosed for example, in U.S. Pat. No. 2,589,036; 3,019,445; 3,793,681; 3,802,032; 4,554,710; and 4,825,821. In general, such devices employ means for engaging either a button hole, or the edge of the shirt adjacent the vertical row of button holes. Such devices are often of complex construction, difficult to use, or easily dislodged and lost. Some function in a manner wherein the necktie panels are immovably anchored to the shirt, thereby causing discomfort when the wearer moves his head rearwardly. Certain earlier disclosed devices further require permanent and specialized modification of the necktie.

It is accordingly an object of the present invention to provide a tie-holding device which remains hidden during use and is easily emplaced.

It is a further object of this invention to provide a device as in the foregoing object which will not damage the tie and requires no modification of the tie.

It is another object of the present invention to provide a device of the aforesaid nature which is not easily dislodged during use, and yet permits limited vertical and lateral movement of the tie.

It is a still further object of this invention to provide a device of the aforesaid nature of simple, durable construction amenable to low cost fabrication.

These objects and other objects and advantages of the invention will be apparent from the following description.

SUMMARY OF THE INVENTION

The above and other beneficial objects and advantages are accomplished in accordance with the present invention by a device for securing to the vertical buttonhole edge of a shirt the front and rear pendant panels of a four-in-hand necktie wherein the rear surface of said front panel has a horizontally disposed designer label loop, said device comprising:

a) spring clip means for engaging the vertical button hole edge of a shirt, and b) holding means for engaging said label loop, said holding means being disposed forwardly of said clip means.

In preferred embodiments, the holding means is adapted to slidingly embrace said label loop and is attached to said spring clip means in perpendicular relationship thereto.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

All the figures show the tie clasp larger than its actual size.

DESCRIPTION OF THE PREFERRED EMBODIMENT

Figure 1:
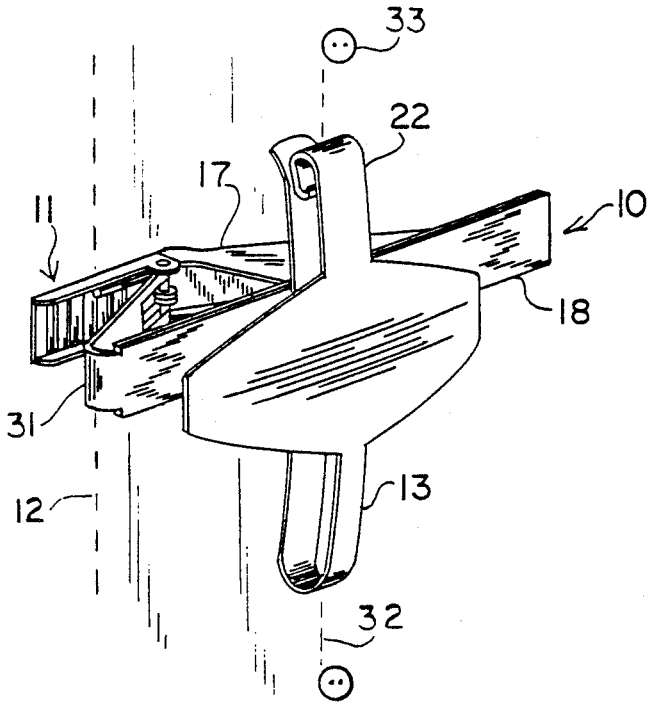
FIG. 1 is a perspective view of a first embodiment of the tie clasp of the present invention.
Figure 2:
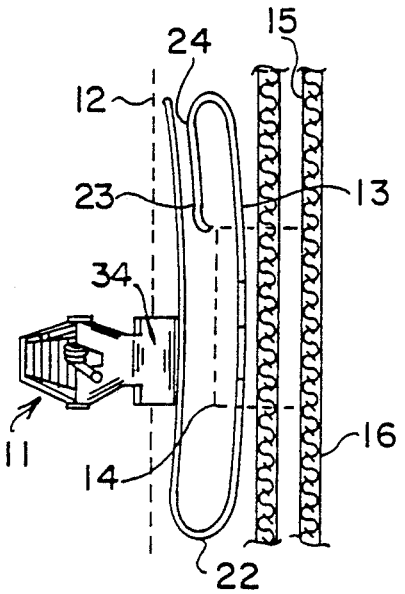
FIG. 2 is a side view of the embodiment of FIG. 1 shown in functional engagement with a necktie illustrated in phantom outline.
Figure 3:
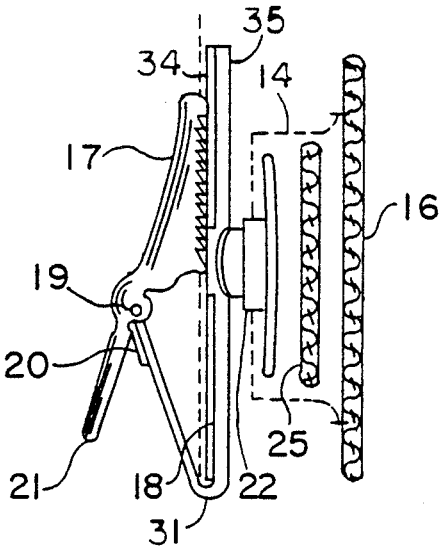
FIG. 3 is a top view of the embodiment of FIG. 1.

Referring to FIGS. 1–3, an embodiment of the necktie clasp 10 of the present invention is shown comprised of spring clip 11 for engaging the vertical button hole edge 12 of a shirt, and holding means 13 adapted to slidingly embrace designer label 14 sewn onto the rear surface 15 of front panel 16 of a four-in-hand necktie.

Spring clip 11 is fashioned in the nature of an alligator clip having a lever member 17 provided with a toothed extremity adapted to engage a base member 18 and attached thereto by rivet 19 which serves as a pivot means. A spring 20 is wound about rivet 19 and has opposite extremities which abut against lever member 17 and base member 18 in a manner to urge said members together so that their interior surfaces 34 are in facing juxtaposition. A manipulating extremity 21 extending as a portion of lever member 17 opposite the toothed extremity, enables finger applied pressure to move the members apart against the urging of the spring. Base member 18 is bent to form a retaining elbow 31 that receives button hole edge 12.

Holding means 13, disposed upon outer surface 35 of base member 18, is fashioned in the nature of a constraining loop 22 elongated upon vertical axis 32, and having an opening 23 therein. In use, the alligator clip is positioned horizontally upon the buttonhole edge 12 of a shirt, and the holding means is vertically disposed. The distance between elbow 31 and vertical axis 32 is $\frac{5}{8}''$, which corresponds to the standard spacing between edge 12 and the line upon which the buttons 33 are positioned. Such spacing places holding means 13 directly over the buttons. The designer label 14 is then inserted into loop 22. Because of the elongated nature of loop 22, the engaged necktie has some freedom of motion in a vertical direction. Restraining means in the form of a hook-like extension 24 prevents inadvertent escape of the designer label 14. It is to be further noted that rear panel 25 of the necktie is positioned between loop 22 and front panel 16. The embodiment of the device exemplified in FIGS. 1–3 may be fabricated primarily from a single piece of metal by suitable cutting and bending procedures. The only additional, separate parts required are lever member 17 and spring 20. It is to be noted, particularly in FIG. 3, that manipulating extremity 21 is laterally spaced from axis 32 less than elbow 31. This assures that the tie clasp will not be seen when worn.

Figure 4:
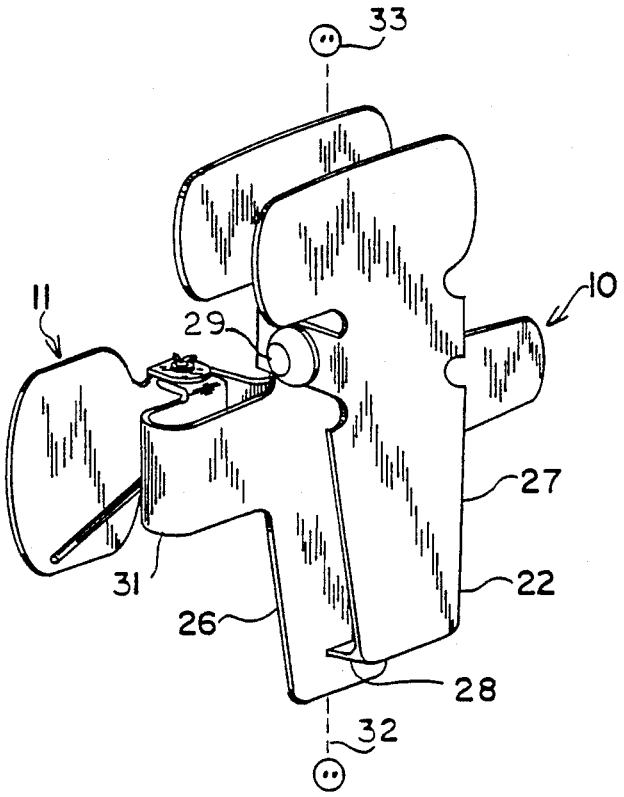
FIG. 4 is a perspective view of a second embodiment of the tie clasp of this invention.
Figure 5:
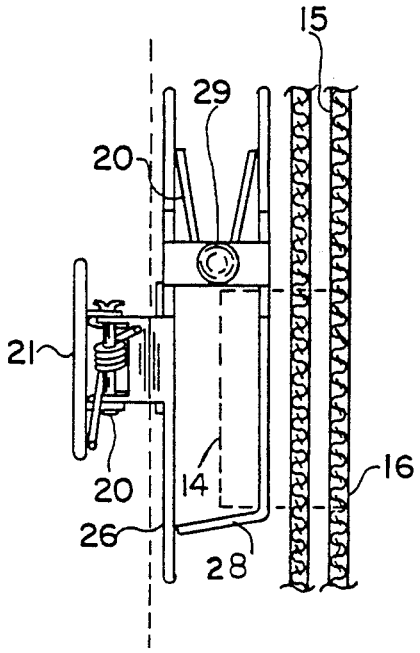
FIG. 5 is a side view of the embodiment of FIG. 4.
Figure 6:
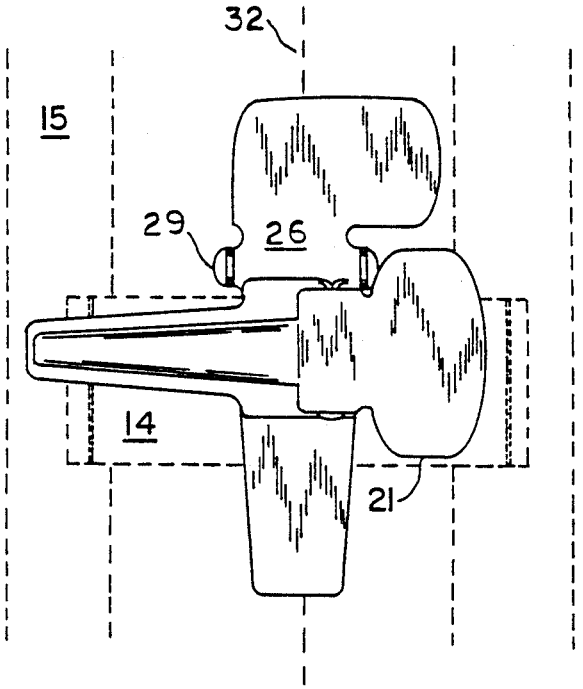
FIG. 6 is a rear view of the embodiment of FIG. 4 shown in functional engagement with a necktie illustrated in phantom outline.

The second embodiment of the device of this invention, illustrated in FIGS. 4–6 is similar to the first embodiment illustrated in FIGS. 1–3. The primary difference between the embodiments is that, whereas the elongated loop 22 of the first embodiment is a stationary, integral portion of the device, the constraining loop 22 of the second embodiment is operable by virtue of a spring clip type of construction. In particular, loop 22 is comprised of a stationary base 26 of elongated configuration disposed perpendicularly to spring clip 11 and integral therewith, and a constraining arm 27 having an inwardly directed lower extremity 28. Constraining arm 27 is attached by pivot pin 29 to base 26 at a site above spring clip 11. A spring 20 held by a pivot pin 29 acts to urge lower extremity 28 into contact with base 26, and in this manner forms a closed loop adapted to engage the designer label.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A device for securing to the vertical buttonhole edge of a shirt the front and rear pendant panels of a four-in-hand necktie wherein the rear surface of said front panel has a horizontally disposed designer label loop, said device comprising:

a) clip means for engaging said button hole edge and comprised of a horizontally elongated lever having interior and outer surfaces, a horizontally elongated base member having interior and outer surfaces and a retaining elbow, pivot means which interengage said lever and base member, and a spring associated with said pivot means and serving to urge said lever and base member together so that said interior surfaces are in facing and abutting juxtaposition, and b) an elongated constraining loop for engaging said label loop, disposed upon the outer surface of said base member, having an opening therein, and centered upon a vertical axis orthogonal to said base member and laterally spaced about $\frac{5}{8}$ inch from said retaining elbow.

2. The device of claim 1 wherein said retaining elbow is formed as a bend in said base member and is adapted to contact said button hole edge.

3. The device of claim 1 wherein said lever is comprised of a toothed extremity adapted to contact said base member, and a manipulating extremity on the opposite side of said pivot means with respect to said toothed extremity.

4. The device of claim 3 wherein said manipulating extremity extends horizontally no further than said base member.

* * * * *